US005894969A

United States Patent [19]

Speckert

[11] Patent Number: 5,894,969

[45] Date of Patent: Apr. 20, 1999

[54] GARMENT DISPLAY HANGER

[76] Inventor: Andrew Speckert, 2965 Lakeroad, Dollard-des-Ormeaux, Québec, Canada, H9B 2M1

[21] Appl. No.: 08/957,257

[22] Filed: Oct. 24, 1997

[51] Int. Cl.[6] ..... A47G 25/30; A47G 25/28

[52] U.S. Cl. ..... 223/85; 223/84

[58] Field of Search ..... 223/85, 94, 95, 223/DIG. 3, 92, 84

[56] References Cited

U.S. PATENT DOCUMENTS

| | | | |
|---|---|---|---|
| D. 184,375 | 2/1959 | Schaefer | 223/85 |
| D. 194,767 | 3/1963 | Warmath, III | 223/DIG. 3 |
| D. 316,571 | 4/1991 | Romero-Comas et al. . | |
| D. 368,805 | 4/1996 | Hatakeyama . | |
| 2,494,400 | 1/1950 | McNutt | 223/95 |
| 2,904,235 | 9/1959 | Crockett | 223/95 |
| 4,542,838 | 9/1985 | Perez-Tubens et al. . | |
| 4,805,816 | 2/1989 | Freund . | |
| 4,892,238 | 1/1990 | Pinczykowski | 223/94 |

FOREIGN PATENT DOCUMENTS

| | | | |
|---|---|---|---|
| 163192 | 5/1958 | Sweden | 223/85 |

*Primary Examiner*—Bibhu Mohanty

[57] ABSTRACT

A one-piece, flat, garment display hanger having a generally T-shape with a relatively long top crossbar and a relatively short bottom crossbar. Vertical spacer means space the crossbars from each other. Hook means on the top crossbar suspend the hanger. The hanger is inserted into a garment to locate the bottom crossbar in the crotch of the garment and to locate the waist of the garment about the top crossbar. The spacer means is long enough to slightly stretch the garment between the crossbars to give a representation of how the garment would look when worn.

10 Claims, 3 Drawing Sheets

GARMENT DISPLAY HANGER

BACKGROUND OF THE INVENTION

1. Field of the Invention

This invention is directed toward a garment display hanger. The invention is more particularly directed toward a garment display hanger of the type for displaying underwear such as briefs or panties.

2. Description of the Related Art Including Information Disclosed under CFR §§ 1.97–1.99

Underwear is usually sold in stores in packages. The buyer has difficulty in visualizing how the packaged underwear, particularly women's lingerie, will look when worn. Several attempts have been made to overcome this problem by providing various flat forms on which the underwear can be mounted. The forms are adapted to be hung and usually are shaped to simulate a human torso. The buyer can see how the apparel article looks when mounted on the form in a manner similar to manner it is worn. Examples of such forms are shown in U.S. Pat. Nos. D368,805; 4,805,816 and 4,542,838.

The known forms or display hangers are however quite expensive to manufacture and have not found widespread use. The solid hanger forms, such as shown in U.S. Pat. Nos. 4,542,838 and 4,805,816, use too much material and are too expensive. Even the known forms which just provide an outline of the hips or torso of a person, as shown in U.S. Pat. No. D368,805 for example, are expensive in their use of material particularly since they must be rigid enough to maintain their shape.

Undergarments, particularly women's lingerie, are cut so that the leg openings are higher in the front than in rear. Thus the leg openings are quite well defined when looking at the garment from the front. However, the known forms or display hangers, in providing an outline of the hips or torso, hide the rear of the garment and thus the leg openings are not as apparent. As a result the garment is not as attractively displayed on the known forms or display hangers.

SUMMARY OF THE INVENTION

It is the purpose of the present invention to provide a garment display hanger that is simpler in construction and less expensive to manufacture than the known display hangers. It is another purpose of the present invention to provide a garment display hanger that more attractively displays the garment, particularly when it is women's lingerie.

In accordance with the present invention there is provided a garment display hanger that is T-shaped having a top crossbar long enough to hold the garment by its waist. The hanger has a very short bottom crossbar just long enough to hold the garment by its crotch. Central spacer means extend between the top and bottom crossbars and are long enough to hold the garment lightly stretched between the top and bottom crossbars. The material employed in such a hanger is minimal and yet the hanger adequately displays the garment so the buyer can see what the garment would look like if worn. Also, because of the T-shape of the hanger, the leg openings of the garment are accentuated to more attractively display the garment. The hanger can be modified to have arms extending down from the ends of the top crossbar to shape the sides of the garment, if needed, depending on the style of the garment. The arms can be braced to the top crossbar and/or the spacer means to retain rigidity in the hanger.

The invention is particularly directed toward a one piece, flat, garment display hanger having a generally T-shape with a relatively long top crossbar and means on the top crossbar to suspend the hanger. The top cross bar is long enough to hold a garment by insertion in its waist. The hanger has a relatively short bottom crossbar, just long enough to hold the garment by insertion in its crotch. The bottom cross bar is centrally located relative to the top crossbar and is spaced from the top cross bar by spacer means extending vertically up from the center of the bottom cross bar to the top cross bar. The spacer means is long enough to hold the garment flat on the hanger between the cross bars.

DESCRIPTION OF THE PREFERRED EMBODIMENTS

Figure 1:
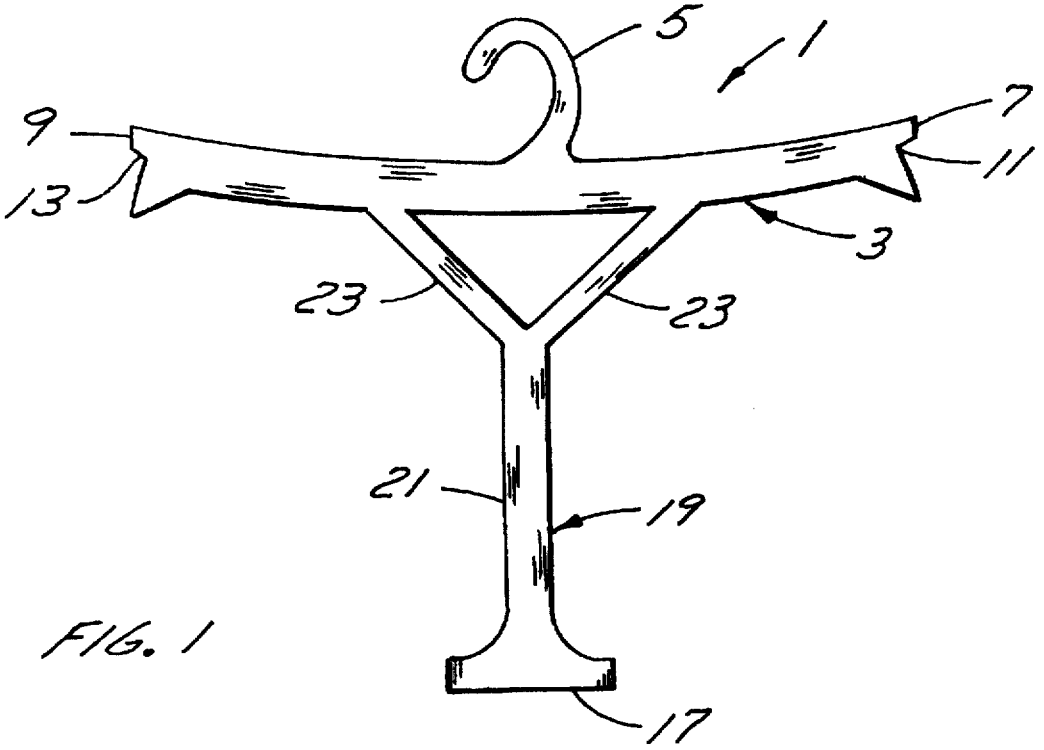
FIG. 1 is a front view of the garment display hanger.

The garment display hanger 1, as shown in FIG. 1, is generally T-shaped with a top crossbar 3 having a length on which the waistband of the garment can be mounted. A hanger hook 5 is on the top of the crossbar 3 and centered thereon. The ends 7, 9 of the crossbar 3 can be slightly indented, as shown at 11, 13 to help hold the waistband of the garment thereon. The crossbar 3 is made slightly concave, from its top, to simulate the curvature of a person's waist.

The hanger includes a bottom crossbar 17 that is quite short and is centered with respect to the top crossbar 3. The bottom crossbar 17 holds the crotch of the garment and is long enough to span the crotch. Vertical spacer means 19 connect the bottom crossbar 17 with the upper crossbar 3. The vertical spacer means 19 can comprise a Y-shaped member having a long, wide bottom stem 21 that is substantially narrower than the bottom cross bar 17 and relatively short diverging top arms 23 that extend from the top of the stem 21 to connect to the top cross bar 3 near its ends 7, 9. The spacer means 19 can be made in various lengths to suit the rise of the garments to be displayed. The hanger can be molded in one piece from suitable plastic material. This hanger, with short ends 7, 9 on the top cross bar 3, is used with garments having very high cut leg openings and thus narrow waist portions at the sides of the garment.

Figure 2:
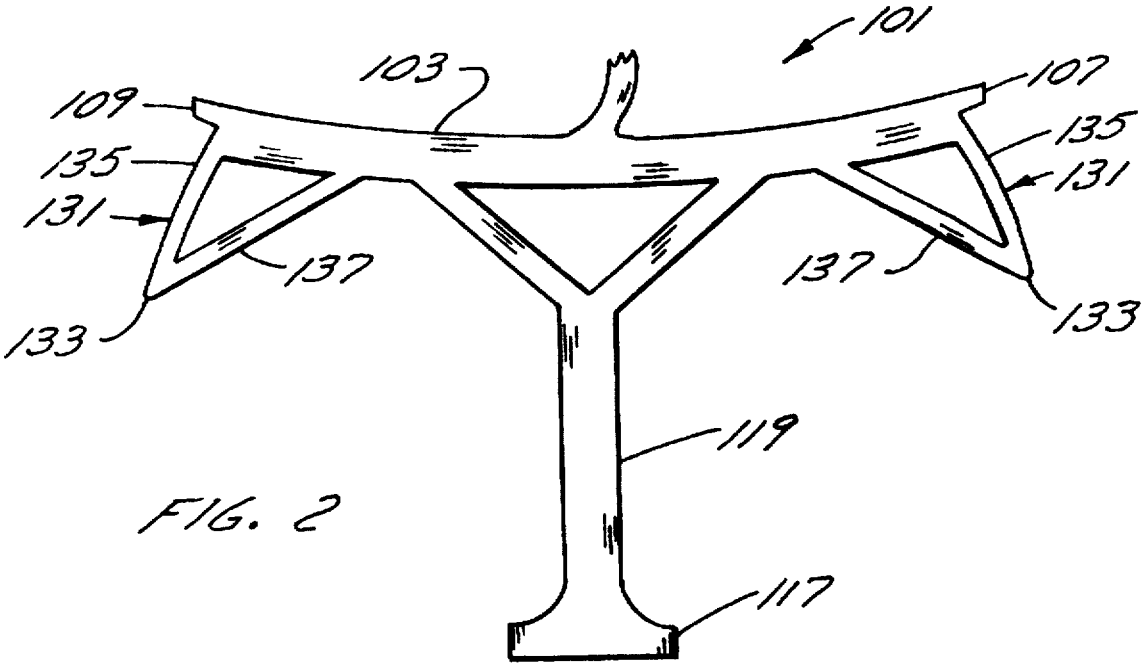
FIG. 2 is a front view of another embodiment of the hanger.

In another embodiment, the hanger 101 can be provided with downwardly extending arms at the ends of the top crossbar 103. As shown in FIG. 2, these arms 131 extend down from the ends 107, 109 of the top crossbar 103 and flare outwardly so that their lower end 133 is spaced outwardly from their upper end 135. If necessary, braces 135 can extend from the lower portion of the arms 131 to the top crossbar 103 or to the arms 123 of the spacer means 119 as shown. The outwardly flaring arms 131 are used with garments that have slightly lower cut leg openings than the garments used with hanger 1 and help shape the sides of the garment to how it would look on a person's hips.

Figure 3:
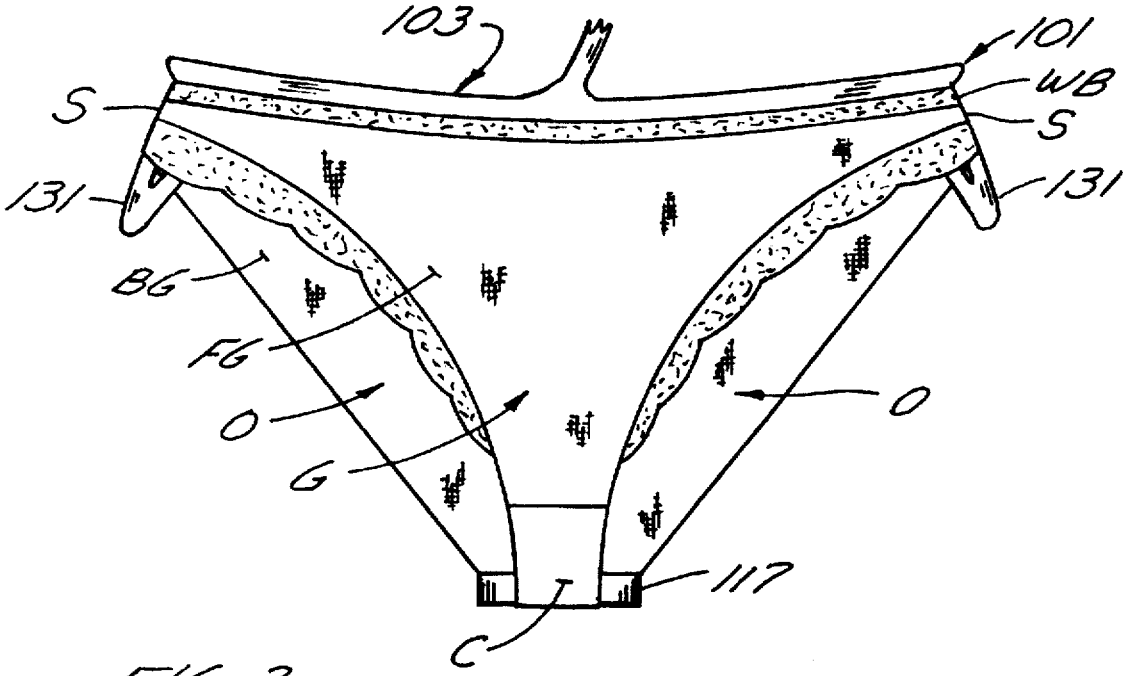
FIG. 3 is a front view of the hanger shown in FIG. 2 with a garment mounted thereon.

FIG. 3 shows the hanger 101 carrying a garment G. The garment G has relatively high leg openings O giving the garment a relatively narrow waist on the sides S. The garment G is mounted on the hanger by mounting the waistband WB of the garment on the top crossbar 103, the outwardly flaring arms 131 retaining the waistband WB in place as shown in FIG. 3. The crotch C of the garment is mounted on the bottom crossbar 117. The hanger 1 displays the garment G as it would look when worn. The leg openings O of the garment are clearly displayed since the front of the garment FG around the leg openings is cut slightly higher than the back of the garment BG around the leg openings O and this makes the presentation of the garment more attractive to buyer.

Figure 4:
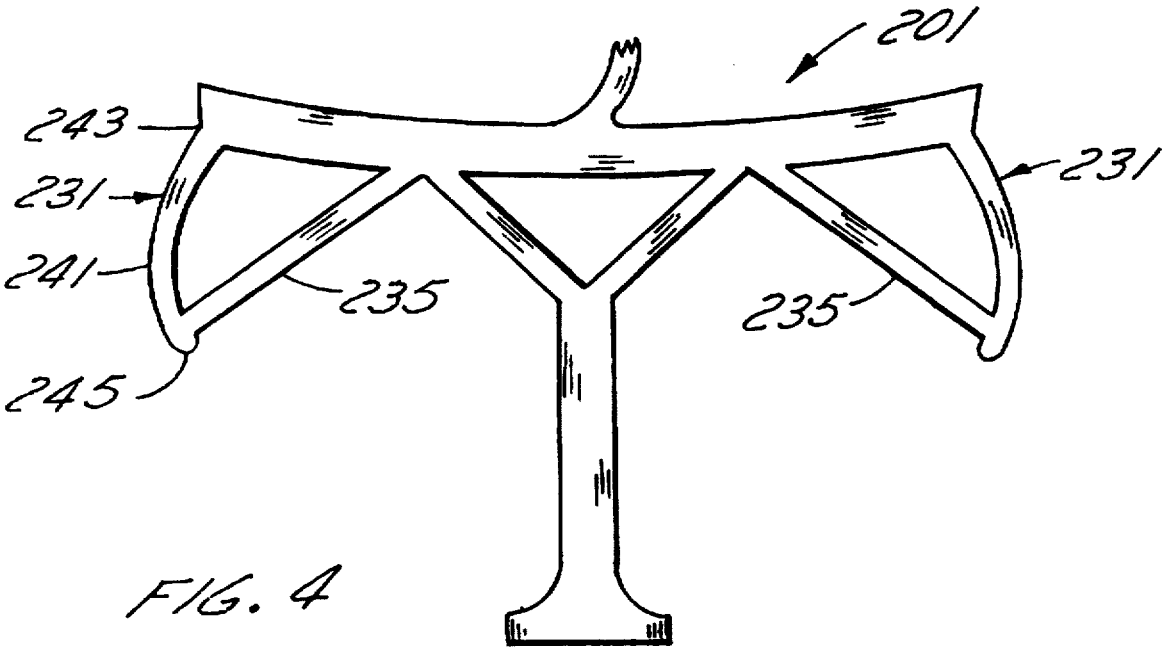
FIG. 4 is a front view of yet another embodiment of the hanger.

In a further embodiment, the downwardly extending arms 231 can be relatively long so that they are bowed outwardly with the center portion 241 of the arms 231 spaced outwardly from the upper and lower ends 243, 245 of the arms as shown in FIG. 4. This hanger 201 is for use with garments having very low cut leg openings. The long arms 231 again simulate a person's hips but for a longer length. Braces 235 can again be used to strengthen the arms 231.

Figure 5:
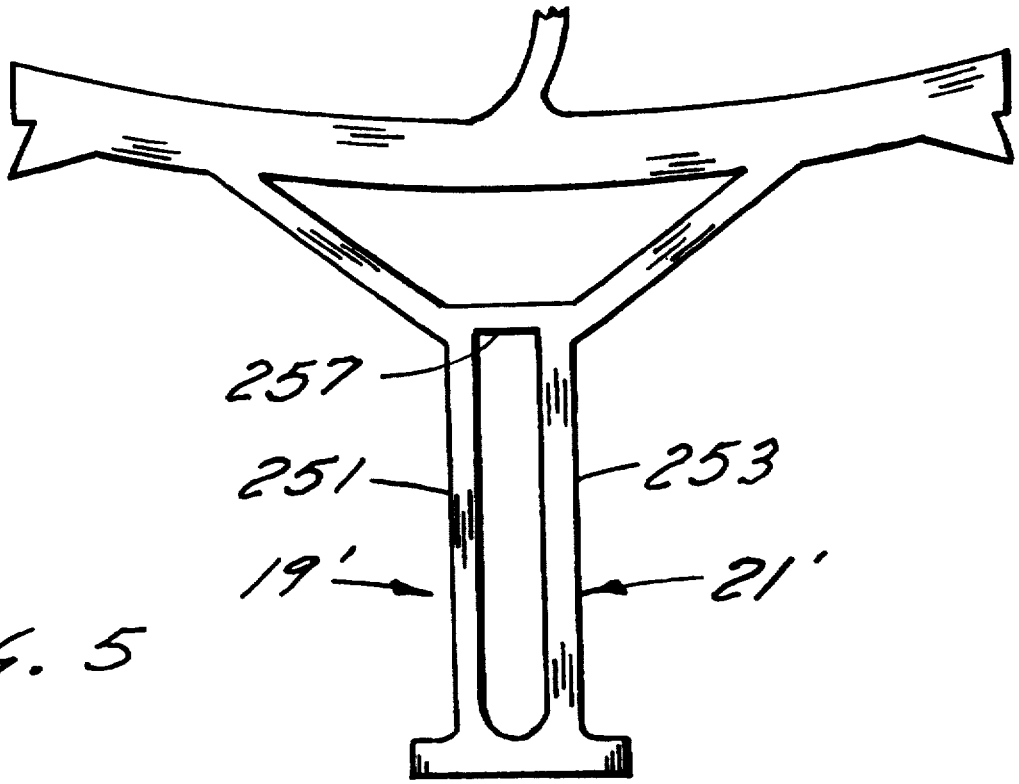
FIG. 5 shows another modification of the hanger.

If desired, the stem 21 of the spacer means 19 can be made from two parallel vertical legs 251, 253 as shown in FIG. 5. A cross bar 257 joins the legs 251, 253 at their upper portion to impart rigidity. The wider stem can be used with garments having a slightly wider crotch to maintain rigidity in the hanger and prevent twisting.

While the display hanger has been described for use for with undergarments, ladies or mens, it can be used with similar types of garments such as bathing suits.

The display hanger permits the garments to be easily mounted and removed. The garment is mounted by merely inserting the hanger into the garment to place the small, bottom, crossbar in the crotch and then pulling the waist of the garment up around the long, top crossbar. The elastic in the waistband, and the detents in the ends of the top crossbar, hold the garment in place while it is lightly stretched between the crossbars. No clips, hooks, slots or cutouts, which can leave marks on the garment, sometimes permanently, are needed to mount the garment on the hanger. Instead, the hanger is sized to mount the garment in a slightly stretched condition between the crossbars. The hanger gives an accurate representation of what the garment would look like when actually worn helping the buyer decide more quickly what garment to purchase.

I claim:

1. A one-piece, flat, garment display hanger having a generally T-shape with: a relatively long top cross bar, the top cross bar having retaining means at its ends to receive and retain the waistband of a garment thereon in a slightly stretched condition; means on the top cross bar to suspend the hanger; a relatively short, straight, bottom cross bar, centrally located relative to the top cross bar and long enough to span the crotch of the garment when inserted in the crotch; the bottom cross bar spaced from the top cross bar by vertical spacer means extending up from the center of the bottom cross bar to the top cross bar, the spacer means long enough to hold the garment flat on the hanger between the cross bars whereby the hanger will generally display the garment as it would look when worn.

2. A garment display hanger as claimed in claim 1 having arms extending down from the ends of the cross bar to shape the top, sides of the garment.

3. A garment display hanger as claimed in claim 2 wherein the arms are relatively short and flare outwardly with the bottom free end of each arm well outside the upper end of the arm.

4. A garment display hanger as claimed in claim 2 wherein the arms are relatively long and are bowed outwardly with the center of each arm outside the upper and lower ends of the arms.

5. A garment display hanger as claimed in claim 1 wherein the top cross bar is concavely curved from its top to have the waist band of the garment follow the cross bar.

6. A garment display hanger as claimed in claim 2 wherein the top cross bar is concavely curved from its top to have the waist band of the undergarment follow the cross bar.

7. A garment display hanger as claimed in claim 1 wherein the retaining means comprise a detent at each end of the top cross bar.

8. A garment display hanger as claimed in claim 7 having arms extending down from the ends of the cross bar, below the detents, to shape the top, sides of the garment.

9. A garment display hanger as claimed in claim 8 wherein the arms are relatively short and flare outwardly with the bottom free end of each arm well outside the upper end of the arm.

10. A garment display hanger as claimed in claim 8 wherein the arms are relatively long and are bowed outwardly with the center of each arm outside the upper and lower ends of the arms.

* * * * *